US009816727B2

(12) United States Patent
Young

(10) Patent No.: US 9,816,727 B2
(45) Date of Patent: Nov. 14, 2017

(54) EXPANDABLE EXOTHERMIC GEL-FORMING COMPOSITION

(75) Inventor: Daniel L. Young, Henderson, NV (US)

(73) Assignee: Forever Young International, Inc., Henderson, NV (US)

( * ) Notice: Subject to any disclaimer, the term of this patent is extended or adjusted under 35 U.S.C. 154(b) by 1066 days.

(21) Appl. No.: 13/387,258

(22) PCT Filed: Jul. 26, 2010

(86) PCT No.: PCT/US2010/043226
§ 371 (c)(1),
(2), (4) Date: Apr. 9, 2012

(87) PCT Pub. No.: WO2011/017047
PCT Pub. Date: Feb. 10, 2011

(65) Prior Publication Data

US 2012/0186141 A1 Jul. 26, 2012

Related U.S. Application Data

(60) Provisional application No. 61/228,594, filed on Jul. 26, 2009, provisional application No. 61/315,807, filed on Mar. 19, 2010.

(51) Int. Cl.

| | |
|---|---|
| ***C09K 5/16*** | (2006.01) |
| ***C09K 5/18*** | (2006.01) |
| ***A47J 36/28*** | (2006.01) |
| ***A47J 36/30*** | (2006.01) |
| ***F24J 1/00*** | (2006.01) |

(52) U.S. Cl.
CPC ..... *F24J 1/00* (2013.01)

(58) Field of Classification Search
CPC .. A47J 36/28; A47J 36/30; C09K 5/18; C09K 5/16
USPC ..... 44/253
See application file for complete search history.

(56) References Cited

U.S. PATENT DOCUMENTS

| | | | | |
|---|---|---|---|---|
| 4,264,362 | A * | 4/1981 | Sergev | B22F 9/04 423/657 |
| 4,522,190 | A * | 6/1985 | Kuhn | A61F 7/03 126/204 |
| 5,496,890 | A * | 3/1996 | Beckmann | C08F 8/44 525/329.1 |
| 5,611,329 | A | 3/1997 | Lamensdorf | |
| 5,984,995 | A * | 11/1999 | White | A61F 7/034 126/263.05 |
| 6,271,278 | B1 * | 8/2001 | Park | A61L 15/60 521/102 |
| 6,548,015 | B1 | 4/2003 | Stubbs et al. | |
| 2004/0112366 | A1 * | 6/2004 | Addison | A47C 7/021 126/204 |
| 2007/0068339 | A1 | 3/2007 | York-Leung Wong et al. | |
| 2007/0068508 | A1 | 3/2007 | York-Leung Wong | |
| 2007/0156213 | A1 * | 7/2007 | Friedensohn | A61F 7/03 607/114 |
| 2009/0004229 | A1 | 1/2009 | Pastini et al. | |

FOREIGN PATENT DOCUMENTS

| | | |
|---|---|---|
| CA | 2414166 | 1/2002 |
| CA | 2620816 | 3/2007 |
| JP | S60-174455 A | 9/1985 |
| JP | H11-508314 A | 7/1999 |
| WO | 2005021056 A1 | 3/2005 |

OTHER PUBLICATIONS

International Bureau, International Search Report for International Application No. PCT/US2010/043226, dated Feb. 10, 2011, pp. 1-2, Geneva, Switzerland.
International Bureau, International Preliminary Report on Patentability Chapter I for International Application No. PCT/US2010/043226, dated Jan. 31, 2012, pp. 1-4, Geneva, Switzerland.
International Bureau, Written Opinion of the International Search Authority for International Application No. PCT/US2010/043226, dated Jan. 26, 2012, pp. 1-4, Geneva, Switzerland.
International Bureau, Informal Comments by Applicant on WO-ISA for International Application No. PCT/US2010/043226, dated Jan. 26, 2012, pp. 1-3, Geneva, Switzerland.
D4: Superabsorbent Polymer Materials: A Review, M. J. Zohuriaan-Mehr and K. Kabiri, Iranian Polymer Journal 17(6), 2008, 451-477.

* cited by examiner

*Primary Examiner* — Ellen McAvoy
*Assistant Examiner* — Ming Cheung Po
(74) *Attorney, Agent, or Firm* — Troutman Sanders LLP

(57) ABSTRACT

This invention is in the field of expandable, exothermic gel-forming compositions that are predominately useful in the consumer products and medical industries. More particularly, it relates to the use of expandable particulate exothermic gel-forming compositions with efficient and long-lasting heat production for heating surfaces and objects without the need for electricity or combustible fuel.

20 Claims, No Drawings

EXPANDABLE EXOTHERMIC GEL-FORMING COMPOSITION

CROSS REFERENCE TO RELATED APPLICATIONS

This application is United States national stage entry of International Application no. PCT/US2010/043226 entitled "Expandable Exothermic Gel-Forming Composition" and filed Jul. 26, 2010, which claims priority to U.S. Provisional Application Ser. Nos. 61/228,594, filed on Jul. 26, 2009, entitled "Exothermic Gel with Long Lasting Heat Formation"; and 61/315,807, filed on Mar. 19, 2010, entitled "Expandable Exothermic Gel-Forming Compositions." The contents of each of these prior patent applications are incorporated into this application by reference in their entirety as if set forth verbatim.

FIELD

This invention is in the field of expandable, exothermic gel-forming compositions that are predominately useful in the consumer products and medical industries. More particularly, it relates to the use of expandable particulate exothermic gel-forming compositions with efficient and long-lasting heat production for heating surfaces and objects without the need for electricity or combustible fuel.

BACKGROUND

The ability to produce heat "on the spot" without the use of electricity or burning fuels is desirable in a variety of different applications. In the cosmetic industry, heat is desired for the application of various cosmetics to the skin and scalp. In the medical profession, application of heat is important in physical therapy, orthopedics, wound healing, arthritis treatment, etc. In consumer products, the ability to keep food and other substances hot, as well as to heat them initially, is desired when other means of heating are not convenient or unavailable.

The utility of exothermic chemical reactions in such applications has been described. For example, the military has used a "flameless heating device" (FDE) for heating rations in the field since at least 1973. This FDE was in the form of a "hot sheet" consisting of a magnesium anode, a carbon electrode and an electrolyte salt. More recently, the military developed a dismounted ration heating device (DRHD) utilizing chemical heating pads composed of magnesium-iron alloy particles trapped in a semi-solid polyethylene matrix (U.S. Pat. No. 4,522,190).

Other examples of metal alloy particles to produce heat in the cosmetic industry have been described for use in conjunction with paper-based "fluff" as the absorptive material. However, such systems have relatively low energy potential and thus exhibit a short duration exothermic reaction, as well as non-uniform heating.

Accordingly, there is a need for compositions that can be used to generate heat in a convenient format that is uniform, controllable and long-lasting.

SUMMARY

The following presents a simplified summary in order to provide a basic understanding of some aspects of the claimed subject matter. This summary is not an extensive overview, and is not intended to identify key/critical elements or to delineate the scope of the claimed subject matter.

Its purpose is to present some concepts in a simplified form as a prelude to the more detailed description that is presented later.

In one embodiment, the present invention relates to an expandable, exothermic particulate gel-forming composition comprising galvanic alloy particles blended with a super absorbent polymer (SAP) wherein the gel expands at least two fold (volume per volume) and produces heat for at least one hour when exposed to an aqueous liquid and salt.

The salt may be present in the aqueous liquid, or it may be incorporated into the gel-forming composition, in which case it dissolves in the aqueous liquid when it comes in contact with the gel-forming composition, thus exposing it to the galvanic alloy particles and the SAP.

In one embodiment the electrolyte comprises potassium chloride, sodium chloride or calcium chloride, or mixtures thereof.

The galvanic alloy particles may comprise magnesium and iron.

In addition, the composition may optionally include a binder and/or an encapsulant.

The SAP may, for example be sodium polyacrylate.

The expandable composition can expand, for example, two fold, five fold or even ten fold, volume per volume, when contacted with an aqueous solution such as water.

In one exemplary embodiment, the gel-forming composition has an absorption capacity of greater than 400 grams of wet weight per starting grams of dry weight.

The composition can be formed from galvanic alloy particles which are in turn formed from a mixture of between 2-20% by weight iron and 80-98% by weight magnesium. In addition, it can be formed by mixing a weight ratio of 20:1 to 5:1 galvanic alloy particles to super absorbent polymer.

In another embodiment, the galvanic alloy particles are microencapsulated by a polymer, such as hydroxypropyl methylcellulose.

The composition can also be part of a kit, along with an aqueous activator solution. In such a kit, the electrolyte is either contained in the exothermic particulate gel-forming composition or the aqueous activator solution.

Other aspects of the invention are found throughout the specification.

DETAILED DESCRIPTION

This invention is in the field of expandable, exothermic gel-forming compositions that are predominately useful in the consumer products and medical industries. More particularly, it relates to the use of expandable, particulate exothermic gel-forming compositions with long-lasting and efficient heat production for heating surfaces and objects without the need for electricity or combustible fuel.

The exothermic gel-forming compositions of the present invention are generally formulated from galvanic alloy particles mixed with super absorbent polymers. In one embodiment, the galvanic alloy particles and/or the particulate gel-forming compositions are further processed to include some degree of encapsulation of components to control the exothermic reaction. The gel-forming compositions are activated upon contact with an activator solution, such as an aqueous electrolyte solution. The galvanic alloy particles generally consist of two metallic agents with different oxidation potentials, and either the gel forming composition or the activator solution also includes at least one electrolyte.

Galvanic Alloy Particles

The alloy particles of the present invention generally consist of a mixture of two or more metallic agents, each with a different oxidation potential, such that one serves as the cathode and the other serves as the anode in an electrochemical reaction, once the two components of the composition are brought into electrical contact with one another via an activator solution.

Exemplary metallic agents for use in the present invention include mixtures of copper, nickel, palladium, silver, gold, platinum, carbon, cobalt, aluminum, lithium, iron, iron(II) oxide, iron(III)oxide, magnesium, $Mg_2Ni$, $MgNi_2$, $Mg_2Ca$, $MgCa_2$, $MgCO_3$, and combinations thereof. For example, platinum may be dispersed on carbon and this dispersion used as a cathode material. See U.S. Pat. Nos. 3,469,085; 4,264,362; 4,487,817; and 5,506,069.

An exemplary anode material is magnesium, which reacts with water to form magnesium hydroxide ($Mg(OH)_2$) and hydrogen gas, and generates large amounts of heat. Other metallic agents having high standard oxidation potentials (such as lithium) may also serve as the anode material, but are less preferred from a cost and safety standpoint. The cathode material will have a lower standard oxidation potential than the anode material. The cathode is not consumed in the electrochemical interaction, but serves as a site for electrons given up by the corroding anode to neutralize positively charged ions in the electrolyte. Exemplary cathode materials include iron, copper and cobalt.

Any of the usual methods can be employed in the production of a galvanic alloy, such as conventional dissolution or mechanical alloying. The process of mechanical alloying involves inducing a solid state reaction between the components of an initial powder mixture by repeated mechanical deformations caused by ball-powder-ball collisions using a high energy ball mill. Such mechanical deformations may include, for example, repeated flattening, fracturing, and welding of metal constituents i.e., active and passive metal particles. The resultant energy produced from the impact of colliding steel balls with particles trapped between them creates atomically clean particle surfaces. These atomically clean particle surfaces allow them to cold-weld together.

The particle sizes of the metallic components before milling may vary from a few microns to a few hundred microns. In one embodiment, it may be desirable to have an average particle size less than 200 microns, such as 100-150 microns, to facilitate efficient alloying.

Exposure to oxygen or certain other reactive compounds produces surface layers that reduce or completely eliminate the cold welding effect. Therefore, an inert atmosphere is usually maintained in the mill to prevent reoxidation of the clean surfaces, thereby avoiding the formation of oxide coatings on the particle surfaces which reduce galvanic cell reactions. An "inert gas" as used herein is an unreactive gas, such as nitrogen, helium, neon, argon, krypton, xenon, radon and also includes the nonoxidizing gas, carbon dioxide. The inert gas should be essentially free of water (less than 10 ppm, such as less than 5 or less than 1 ppm).

Generally, when the milling process is allowed to progress for an extended period of time, the particle structure becomes more refined and the cathode particles reduce in size. However, after a certain point in the milling process, any additional milling will result in a reduction of the corrosion rate due to the cathode material becoming too finely dispersed throughout the anode material. When this occurs, the ratio of cathode/anode particle surface area available for contact with the electrolyte decreases and hence the corrosion rate decreases. The resulting mechanically alloyed powders from a milling process are small particles consisting of matrices of active metal having smaller particles of passive metals dispersed throughout. Accordingly, milling time should be optimized for the best outcome in terms of electrical conductivity. In one embodiment, the galvanic alloy particles consist of magnesium and nickel, magnesium and iron, magnesium and copper, and magnesium and cobalt (U.S. Pat. No. 4,264,362). In magnesium-containing alloys, the magnesium is usually present in greater abundance, such as greater than 75%, 80%, 90% or 95% by weight.

Super Absorbent Polymer

The gel-forming compositions of the present invention comprise a superabsorbent polymer (SAP), also referred to as "slush powder," "water-insoluble absorbent hydro gel-forming polymer," "hydrogel-forming" polymer or "hydrocolloid." The use of SAPs is important because, when combined with an aqueous solution, an expanded gel is created. This water-based gel is able to store a significant amount of the heat generated by the exothermic reaction due to its high specific heat capacity. Thus, the gel stays hot for a relatively long period of time (compared to the exothermic reaction carried out in the absence of gel) and prolongs the duration of time that the object being heated can be maintained at a relatively constant elevated temperature. Additionally, the gel-forming composition expands, thereby providing greater surface area for heat transfer to external objects.

The term "super absorbent polymer" means that the polymer is capable of swelling to 200 gms per gm of dry polymer when exposed to water. Generally, SAPs are loosely cross-linked, three-dimensional networks of flexible polymer chains that carry dissociated, ionic functional groups. The absorption capacity of a SAP relative to a particular material, such as water, is determined by osmotic pressure and the polymer's affinity with that material as well as the polymer's rubber elasticity. The difference between the ion concentration inside a SAP and that of the surrounding water solution determines the intensity of available osmotic pressure. Therefore, the osmotic pressure enables a SAP to absorb a large quantity of water. Additionally, a particular polymer's affinity for its surrounding solution also affects the absorption capacity of the polymer. Thus, based on a polymer's absorptive capacity due to the surrounding osmotic pressure and the polymer's affinity for water, a SAP can absorb large quantities of water and other aqueous solutions without dissolving by solvation of water molecules via hydrogen bonds, increasing the entropy of the network to make the SAPs swell tremendously.

The factor that suppresses a SAP's absorbing power, in contrast, is found in the elasticity of the gel resulting from its network structure. The specific rubber elasticity of a polymer increases with the crosslinking density of the polymer, wherein the absorption capacity of a given SAP reaches its maximum when its rubber elasticity attains equilibrium with its water absorbing power.

Examples of super absorbent polymers are: a polyacrylic acid salt-based polymer, a vinyl alcohol-acrylic acid salt-based polymer, a PVA based polymer or an isobutylene-maleic anhydride polymer. Other examples of SAPs include polysaccharides such as carboxymethyl starch, carboxymethyl cellulose and hydroxypropyl cellulose; nonionic types such as polyvinyl alcohol and polyvinyl ethers; cationic types such as polyvinyl pyridine, polyvinyl morpholinione, and N,N-dimethylaminoethyl or N,N-diethylaminopropyl acrylates and methacrylates; and carboxy groups which include hydrolyzed starch-acrylonitrile graft copolymers, partially neutralized hydrolyzed starch-acrylonitrile graft copolymers, hydrolyzed acrylonitrile or acrylamide copolymers and polyacrylic acids.

Methods of making super absorbent polymers are well known and can be easily optimized to achieve a desired swellability. For example, SAPs can be made from the polymerization of acrylic acid blended with sodium hydroxide in the presence of an initiator to form a polyacrylic acid sodium salt (i.e. "sodium polyacrylate.) Other materials also used to make SAPs are polyacrylamide copolymer, ethylene maleic anhydride copolymer, cross-linked carboxy-methylcellulose, polyvinyl alcohol copolymers and cross-linked polyethylene oxide.

Although there are many types of SAPs commercially available, most are lightly cross-linked copolymers of acrylate and acrylic acid, and grafted starch-acrylic acid polymers prepared by inverse suspension, emulsion polymerization or solution polymerization. Inverse suspension polymerization is generally used to prepare polyacrylamide-based SAPs and involves dispersing a monomer solution in a non-solvent, forming fine monomer droplets to which a stabilizer is added. Polymerization is then initiated by radicals from thermal decomposition of an initiator.

Super absorbent polymers found to be particularly suitable include, for example, AQUA KEEP® Super Absorbent Polymer manufactured by Sumitomo Seika Chemical Company (Osaka, Japan). For some embodiments, a fast-acting version of AQUA KEEP® found to be suitable is AQUA KEEP® 10SH-P. Additional polymers can be found commercially as CABLOC 80HS, available from Stockhausen Inc., Greensboro, N.C.; LIQUIBLOCK® 2G-40, available from Emerging Technologies, Inc., Greensboro, N.C.; SANWET IM1000F, available from Hoechst Celanese Corporation, Bridgewater, N.J.; AQUALIC CA, available from Nippon Shokubai Co., Ltd., Osaka, Japan; and SUMIKA GEL, available from Sumitomo Kagaku Kabushiki Kaisha, Japan. Additional SAPs are also commercially available from a number of manufacturers, such as Dow Chemical (Midland, Mich.) and Chemdal (Arlington Heights, Ill.). Any of the aforementioned SAPs can be included as a blend of two or more polymers, so long as the majority of the polymer (more than 50% and preferably more than 70%, weight per weight) has an absorption capacity equal to or greater than 200 gms per gram.

Absorption measurements can be conducted under several methods, including the tea-bag method, centrifuge method and sieve method. According to the tea-bag method, a sample is placed in a bag measuring about 5×5 cm and the bag is then sealed around its perimeter. The bag is then placed in a dish with an excess of either water or 0.9% NaCl solution and the sample is allowed to absorb the solution and swell freely in the bag for one hour or until it reaches equilibrium. The bag is then removed to separate the sample from any excess solution and weighed to calculate the swelling capacity. The absorption capacity of the polymer sample can then be calculated in accordance with the following formula:

$$A_s = \frac{m_m - m_b(1 + A_b) - \mathrm{ms}}{m_s}$$

Where: $A_s$=sample absorbency; $A_b$=tea bag material absorbency; $m_m$=weight of tea bag with sample after absorption; $m_b$=weight of empty, dry tea bag; and $m_s$=weight of dry sample.

In one embodiment, the SAP (or at least a majority of the SAP if a blend of two or more is used) has an absorption capacity of at least 200 g/g, where 1 g of SAP is capable of absorbing up to 200 g of water.

In another embodiment, the SAP is also a "fast acting polymer," or "FAP," which has an absorption rate of no more than 20 seconds, and more preferably no more than 10 seconds or no more than 5 seconds. These water absorption rates in seconds are usually included in manufacturer's specifications for the various SAPs.

Optional Binders

The gel-forming composition optionally includes at least one binder, such as a polymer or plastic, in addition to the SAP. Exemplary binders include natural resins, synthetic resins, gelatins, rubbers, poly(vinyl alcohol)s, hydroxyethyl celluloses, cellulose acetates, cellulose acetate butylates, poly(vinylpyrrolidone)s, casein, starch, poly(acrylic acid)s, poly(methylmethacrylic acid)s, poly(vinyl chloride)s, poly (methacrylic acid)s, styrene-maleic anhydride copolymers, styrene-acrylonitrile copolymers, styrene-butadiene copolymers, poly(vinyl acetal)s (e.g., poly(vinyl formal) and poly (vinyl butyral)), poly(ester)s, poly(urethane)s, phenoxy resins, poly(vinylidene chloride)s, poly(epoxide)s, poly (carbonate)s, poly(vinyl acetate)s, poly(olefin)s, cellulose esters, and poly(amide)s. The binders may added to the gel-forming composition as a solution or emulsion in water or an organic solvent and blended together using known methods.

Optional Encapsulation

In order to control the exothermic reaction and extend the time during which the exothermic gel remains at an elevated temperature, one approach is to encapsulate the galvanic alloy particles or the gel-forming composition to both extend its shelf life and control the release of energy once exposed to the activating solution.

"Encapsulation," as used herein, means that at least portions of the galvanic alloy particles or the gel-forming composition are substantially enclosed in a suitable encapsulation material, such that the encapsulation material is adhered to the surface of the particles.

"Suitable encapsulation material," or "encapsulant," as used herein, means a material that is sufficiently robust to withstand formulation and manufacturing conditions of the gel-forming compositions, is compatible with the formulation and does not adversely impact its performance, with the caveat that extending heat production is not an adverse effect. In addition, a suitable encapsulation material adheres to the composition. Adhesion of the encapsulant may occur through covalent chemical bonding or through non-covalent interactions (e.g., ionic, Van der Waals, dipole-dipole, etc.).

"Microencapsulated," as used herein, means that the average diameter of the encapsulated component is from about 1 μm to about 1000 μm. If the encapsulated component is oblong or asymmetrical, then the average diameter is measured across that part of the component having the greatest length.

In one embodiment, the composition is microencapsulated, and the encapsulated product has an average diameter from about 1 μm to about 1000 μm, alternatively from about 1 μm to about 120 μm, alternatively from about 1 μm to about 50 μm, and alternatively from about 1 μm to about 25 μm. In another embodiment, the encapsulated product has an average diameter from about 100 μm to about 800 μm, or from about 500 μm to about 700 μm, such as 600 μm Non-limiting examples of suitable encapsulation materials include polystyrene, methacrylates, polyamides, nylons, polyureas, polyurethanes, gelatins, polyesters, polycarbonates, modified polystyrenes, and ethylcellulose degradable polymer matrices. In one embodiment, the encapsulation material is poly(lactide-co-glycolide) (PLG), poly(glycidyl-methacrylate)(PGMA), polystyrene, or combinations thereof. In an alternative embodiment, the encapsulant is hydroxypropyl methylcellulose. Suitable encapsulation materials may have a molecular weight of from about 5 kDa to about to about 250 kDa, alternatively from about 200 kDa to about 250 kDa, alternatively from about 50 kDa to about 75 kDa, alternatively from about 10 kDa to about 50 kDa and alternatively from about 10 kDa to about 25 kDa.

It should also be understood that it is possible to encapsulate any or all of the alloy components (i.e., both the cathode and anode), either the cathode and/or the anode separately, with or without the binder. Through routine optimization using different combinations of coatings of varying components and using known encapsulation techniques, the ideal encapsulation format can be determined based on the use to which the composition is being put. For example, for a body wrap intended to achieve a therapeutic benefit for a longer period of time, a less dissolvable coating would be desirable to extend the time period of the heat production. Alternatively, for the administration of a medicament, a more dissolvable coating would be desirable to achieve a higher temperature over a shorter time span.

The chemical properties of the above-described coatings and their use in a variety of fields such as nanotechnology, energetic materials and the medical field is well known and such optimization could be easily achieved based on this vast body of knowledge.

Manufacturing Methods

The gel-forming composition can be prepared from a mixture of SAP and galvanic alloy particles using any of a variety of commercially available mixers and blenders, such as drum mixers, braun mixers, ribbon blenders, blade blenders, V-shaped blenders, batch mixers, etc. A preferred blender is one that does not excessively shear the galvanic alloy particles or the super absorbent polymer. Depending on the type of equipment used, the two main components and any optional components are added to the mixing vessel either sequentially or simultaneously and mixing is carried out until a uniformly blended product is formed.

The particulate gel-forming composition is tested by measuring expansion volume and rate, as well as heat production and retention. A particulate gel-forming composition is considered optimal if it expands (volume/volume) at least two fold, and preferably five fold or even ten fold. It is considered to be "efficient" if it is capable of achieving a temperature of at least 110° F. and maintaining a temperature of at least 105° F. for one hour.

Activating Solution

The activating solution of the present invention is generally an aqueous solution, such as water. It is also important to note that either the gel-forming composition or the activating solution contains at least one electrolyte, which is needed to initiate the exothermic reaction. As used herein, the term "electrolyte" means a substance containing free ions that is electrically conductive. Electrolyte solutions are usually ionic solutions and commonly exist as solutions of acids, bases or salts. Salts when placed in an aqueous solvent such as water dissociate into their component elements. Examples of preferred electrolytes include potassium chloride, sodium chloride and calcium chloride.

Uses

The gel-forming compositions of the present invention are useful because they form an expanding gel matrix when hydrated, and create a balance between energy release and energy governance. This is brought about by the almost symbiotic relationship between the SAP and the galvanic alloy particles. The gellable particulate absorbs the water very quickly, which limits the reaction potential of the alloy. A controlled reaction then ensues as moisture is transferred from the gel component to the alloy component. This reaction liberates heat and hydrogen gas, and creates oxides of the alloy. This heat is transferred back into the gel which stores the heat rather than letting it escape into the air. This synergistic heat storage and distribution system provides a beneficial effect for commercial applications such as medical, therapeutic and beauty treatments. Since the gel-forming particles expand as they are hydrated, they can be incorporated into any of a number of different apparatuses and as they swell, they expand where desired, which can be used to create an even blanket of exothermic gel, thereby maximizing surface area contact and eliminating areas of non-uniform heat.

EXAMPLES

In the examples that follow, the conditions such as weight ratios, mixing times, etc., can easily be optimized for the particular intended use. For example, in a consumer product such as a beverage warming cup, it would be desirable to manufacture a composition that achieves a higher temperature than for a medical product intended to contact the skin.

Example 1

Galvanic Alloy Particles

In one embodiment, magnesium-iron particles are prepared by mixing together 2-20% by weight iron with 80-98% by weight magnesium in a hermetically sealed ball mill. Air is evacuated with an inert dry gas prior to milling. Milling continues at or near room temperature (e.g., 15 to 50° C.) until the product is uniform.

The galvanic alloy product is tested for its ability to react when contacted with saline solution (e.g., 0.5 to 10% sodium chloride) by measuring a loss in weight, primarily due to the emission of water vapor.

Example 2

Gel-Forming Composition

The galvanic alloy particles as described above are mixed with a super absorbent polymer in a weight ratio of 20:1 to 5:1 galvanic alloy particles to super absorbent polymer. An electrolyte such as sodium chloride is added to the mixture at a weight percentage of, for example, between 0.05 to 10%. Because the electrolyte is the exothermic reaction catalyst, the higher percentage would achieve a hotter temperature than the lower percentage.

The mixture is placed in a suitable blending apparatus and blended to homogeneity.

Example 3

Performance of Gel-Forming Compositions

A given weight of the particulate gel-forming composition from Example 2 is placed in a tared beaker, and the beaker is placed in a bath of water at a constant temperature, such as 125° F. A given volume of aqueous solution (e.g., water) is added to the beaker. The temperature of the composition in the beaker is monitored for one hour and recorded at intervals such as every 5 minutes.

The composition is considered acceptable if it reaches a temperature of at least 110° F. and maintains a temperature of at least 105° F. for one hour.

It will be understood that many additional changes in the details, materials, steps and arrangement of parts, which have been herein described and illustrated to explain the nature of the invention, may be made by those skilled in the art within the principle and scope of the invention as expressed in the appended claims.

What is claimed is:

1. An expandable, exothermic particulate gel-forming composition comprising:

a powder mixture formed from first and second galvanic alloy particles being blended with a super absorbent polymer, each alloy particle being a metal;

water; and an electrolyte;

wherein the gel-forming composition expands at least two fold (volume/volume) as the powder mixture is hydrated and produces heat for a predetermined duration of time when exposed only to the water and the electrolyte.

2. The composition according to claim 1, wherein the super absorbent polymer comprises an absorption capacity of at least 200 g/g, and wherein the super absorbent polymer is operable to absorb water without dissolving by solvation of water molecules via hydrogen bonds.

3. The composition according to claim 2, wherein the electrolyte comprises potassium chloride, sodium chloride or calcium chloride.

4. The composition according to claim 1, wherein the first and second galvanic alloy particles comprise magnesium and iron.

5. The composition according to claim 1, wherein the exothermic particulate gel-forming composition further comprises at least one binder.

6. The composition according to claim 1, wherein the super absorbent polymer is sodium polyacrylamide.

7. The composition according to claim 1, wherein the gel-forming composition expands at least five fold (volume/volume).

8. The composition according to claim 1, wherein the gel-forming composition expands at least ten fold (volume/volume).

9. The composition according to claim 1, wherein the exothermic particulate gel-forming composition has an absorption capacity of greater than 400 g/g.

10. The composition according to claim 1, wherein the galvanic alloy particles are formed from a mixture of between 2-20% by weight iron and 80-98% by weight magnesium.

11. The composition according to claim 1 formed by mixing a weight ratio of 20:1 to 5:1 galvanic alloy particles to super absorbent polymer.

12. The composition according to claim 1, wherein the galvanic alloy particles are microencapsulated by a polymer.

13. The composition according to claim 12, wherein the polymer is hydroxypropyl methylcellulose.

14. A kit comprising:

a container;

an exothermic particulate gel-forming composition in the container, the composition comprising first and second galvanic alloy particles blended with a super absorbent polymer using a blending apparatus to form a mixture, each alloy particle being a metal;

an aqueous activator solution, an electrolyte contained in either the exothermic gel forming composition or the aqueous activator solution;

wherein the super absorbent polymer is operable to absorb the aqueous activator solution without dissolving by solvation of aqueous activator solution molecules via hydrogen bonds so that the gel-forming composition expands as the mixture is hydrated; and instructions specifying that the composition is activated only upon contact with the aqueous activator solution to produce heat for a predetermined duration of time.

15. The kit according to claim 14, wherein the container is a bag, tea bag, or permeable sachet.

16. The composition of claim 1, wherein the galvanic alloy particles are encapsulated by a gel formed by the super absorbent polymer, and wherein the predetermined duration of time is at least an hour.

17. The composition according to claim 1, wherein the first galvanic alloy particle is an anode and the second galvanic alloy particle is a cathode.

18. A non-combustion exothermic composition comprising:

a galvanic alloy particle blended by a blending apparatus with a super absorbent polymer to form a powder mixture, water, and an electrolyte, wherein the super absorbent polymer is operable to absorb water without dissolving by solvation of water molecules via hydrogen bonds wherein the composition expands as the composition is hydrated at least two fold (volume/volume) and produces heat when the galvanic alloy particle and super absorbent polymer are exposed to the water and electrolyte in the absence of air.

19. A heated hydrogel composition, comprising first and second galvanic alloy particles blended with a super absorbent polymer to form a powder mixture, water, and an electrolyte, wherein each galvanic alloy particle is a metal, wherein the composition produces heat, and a volume of the composition is at least two fold greater than the volume of the super absorbent polymer prior to the powder mixture contacting the water caused by the composition expanding as the powder mixture is hydrated.

20. The composition according to claim 19, wherein the first galvanic alloy particle is an anode and a second galvanic alloy particle is a cathode, wherein combining the powder mixture with water and the electrolyte forms the heated hydrogel composition.

* * * * *